US008360400B2

(12) United States Patent
Leonhardt et al.

(10) Patent No.: US 8,360,400 B2
(45) Date of Patent: Jan. 29, 2013

(54) GUARDRAIL ASSEMBLY, BREAKAWAY SUPPORT POST FOR A GUARDRAIL AND METHODS FOR THE ASSEMBLY AND USE THEREOF

(75) Inventors: Patrick A. Leonhardt, Rocklin, CA (US); Barry D. Stephens, Roseville, CA (US); Michael J. Buehler, Roseville, CA (US); Brent S. Sindorf, Roseville, CA (US)

(73) Assignee: Energy Absorption Systems, Inc., Dallas, TX (US)

( * ) Notice: Subject to any disclaimer, the term of this patent is extended or adjusted under 35 U.S.C. 154(b) by 0 days.

(21) Appl. No.: 13/459,946

(22) Filed: Apr. 30, 2012

(65) Prior Publication Data

US 2012/0211710 A1 Aug. 23, 2012

Related U.S. Application Data

(63) Continuation of application No. 12/629,381, filed on Dec. 2, 2009, now Pat. No. 8,215,619.

(60) Provisional application No. 61/236,287, filed on Aug. 24, 2009, provisional application No. 61/211,522, filed on Mar. 31, 2009.

(51) Int. Cl.
*E01F 15/00* (2006.01)

(52) U.S. Cl. ..... 256/13.1

(58) Field of Classification Search ..... 256/13.1; 404/6

See application file for complete search history.

(56) References Cited

U.S. PATENT DOCUMENTS

| | | | | |
|---|---|---|---|---|
| 398,078 | A | 2/1889 | Peterson | |
| 1,335,302 | A | 3/1920 | Stout | |
| 3,451,319 | A | 6/1969 | Gubela | |
| 3,519,301 | A * | 7/1970 | Somnitz | 293/1 |
| 3,779,591 | A * | 12/1973 | Rands | 293/133 |
| 3,820,906 | A | 6/1974 | Katt | |
| 3,912,404 | A | 10/1975 | Katt | |
| 4,071,970 | A | 2/1978 | Strizki | |
| 4,126,403 | A | 11/1978 | Sweeney et al. | |
| 4,183,695 | A | 1/1980 | Wilcox | |
| 4,330,106 | A * | 5/1982 | Chisholm | 256/13.1 |
| 4,432,172 | A | 2/1984 | Kuykendall et al. | |
| 4,490,062 | A | 12/1984 | Chisholm | |
| 4,607,824 | A | 8/1986 | Krage | |
| 4,655,434 | A | 4/1987 | Bronstad | |
| 4,678,166 | A | 7/1987 | Bronstad et al. | |
| 4,838,523 | A | 6/1989 | Humble et al. | |
| 4,923,319 | A | 5/1990 | Dent | |
| 4,928,928 | A | 5/1990 | Buth et al. | |
| 5,022,782 | A | 6/1991 | Gertz et al. | |

(Continued)

FOREIGN PATENT DOCUMENTS

| | | |
|---|---|---|
| AU | 741450 | 11/1998 |
| AU | 745465 | 2/1999 |

(Continued)

OTHER PUBLICATIONS

Brochure—GS Highway Products, Safety Trailers Inc.—TTMA-100, obtained from the Internet on Jun. 27, 2007 at: http://gsihighway.com/safeltytrailers.htm, 2 pgs.

(Continued)

*Primary Examiner* — Joshua Kennedy
(74) *Attorney, Agent, or Firm* — Brinks Hofer Gilson & Lione

(57) ABSTRACT

A guardrail assembly includes first and second rail sections, with a deforming member deforming the first rail section as it moves relative to the second rail section. Methods of using and assembling a guardrail assembly are also provided.

20 Claims, 11 Drawing Sheets

U.S. PATENT DOCUMENTS

| | | | | |
|---|---|---|---|---|
| 5,078,366 | A | | 1/1992 | Sicking et al. |
| 5,125,194 | A | * | 6/1992 | Granger ..... 52/98 |
| 5,391,016 | A | | 2/1995 | Ivey et al. |
| 5,407,298 | A | | 4/1995 | Sicking et al. |
| 5,547,309 | A | | 8/1996 | Mak et al. |
| 5,642,792 | A | | 7/1997 | June |
| 5,657,966 | A | | 8/1997 | Cicinnati |
| 5,775,675 | A | | 7/1998 | Sicking et al. |
| 5,797,591 | A | | 8/1998 | Krage |
| 5,823,705 | A | | 10/1998 | Jackson et al. |
| 5,924,680 | A | | 7/1999 | Sicking et al. |
| 5,947,452 | A | | 9/1999 | Albritton |
| 5,957,435 | A | | 9/1999 | Bronstad |
| 5,967,497 | A | | 10/1999 | Denman et al. |
| 5,988,598 | A | | 11/1999 | Sicking et al. |
| 6,036,399 | A | | 3/2000 | Schalk |
| 6,082,926 | A | | 7/2000 | Zimmer |
| 6,109,597 | A | | 8/2000 | Sicking et al. |
| 6,129,342 | A | | 10/2000 | Bronstad |
| 6,142,452 | A | | 11/2000 | Denman et al. |
| 6,173,943 | B1 | | 1/2001 | Welch et al. |
| 6,254,063 | B1 | | 7/2001 | Rohde et al. |
| 6,293,727 | B1 | | 9/2001 | Albritton |
| 6,308,809 | B1 | | 10/2001 | Reid et al. |
| 6,398,192 | B1 | | 6/2002 | Albritton |
| 6,435,761 | B1 | | 8/2002 | Bligh et al. |
| 6,457,570 | B2 | | 10/2002 | Reid et al. |
| 6,488,268 | B1 | | 12/2002 | Albritton |
| 6,536,985 | B2 | | 3/2003 | Albritton |
| 6,554,256 | B2 | | 4/2003 | Ochoa |
| 6,619,630 | B2 | | 9/2003 | Albritton |
| 6,668,989 | B2 | | 12/2003 | Reid et al. |
| 6,715,735 | B2 | | 4/2004 | Bligh et al. |
| 6,719,483 | B1 | | 4/2004 | Welandsson |
| 6,783,116 | B2 | | 8/2004 | Albritton |
| 6,793,204 | B2 | | 9/2004 | Albritton |
| 6,843,613 | B2 | | 1/2005 | Gelfand et al. |
| 6,854,716 | B2 | | 2/2005 | Bronstad |
| 6,886,813 | B2 | | 5/2005 | Albritton |
| 6,902,150 | B2 | | 6/2005 | Albertson et al. |
| 7,059,590 | B2 | | 6/2006 | Bronstad |
| 7,063,364 | B2 | | 6/2006 | Bird et al. |
| 7,185,882 | B2 | | 3/2007 | Buth et al. |
| 7,195,419 | B2 | | 3/2007 | Gelfand |
| 7,210,873 | B2 | | 5/2007 | Gelfand |
| 7,325,789 | B2 | | 2/2008 | Buth et al. |
| 7,396,184 | B2 | | 7/2008 | La Turner et al. |
| 7,926,790 | B2 | | 4/2011 | James |
| 2002/0030183 | A1 | | 3/2002 | Albritton |
| 2002/0179894 | A1 | | 12/2002 | Albritton |
| 2003/0175076 | A1 | | 9/2003 | Albritton |
| 2003/0210954 | A1 | | 11/2003 | Kang |
| 2004/0016916 | A1 | | 1/2004 | Bronstad |
| 2006/0027797 | A1 | | 2/2006 | Sicking et al. |
| 2006/0038164 | A1 | | 2/2006 | Sicking et al. |
| 2006/0054876 | A1 | | 3/2006 | LaTurner et al. |
| 2006/0151986 | A1 | | 7/2006 | Reid et al. |
| 2007/0140791 | A1 | | 6/2007 | Gelfand |
| 2007/0237577 | A1 | | 10/2007 | Gelfand et al. |
| 2008/0075529 | A1 | | 3/2008 | Gelfand et al. |
| 2008/0160421 | A1 | | 7/2008 | Hayashida et al. |

FOREIGN PATENT DOCUMENTS

| | | | |
|---|---|---|---|
| AU | 747889 | | 5/2000 |
| AU | 762805 | | 3/2001 |
| EP | 0 738 802 | A1 | 3/1996 |
| EP | 0 924 347 | A1 | 6/1999 |
| EP | 0 994 985 | B1 | 9/2005 |
| GB | 2 023 695 | A | 1/1980 |
| WO | WO 99/32728 | A1 | 7/1998 |
| WO | WO 98/44203 | A1 | 10/1998 |
| WO | WO 98/50637 | A1 | 11/1998 |
| WO | WO 99/02781 | A1 | 1/1999 |
| WO | WO 99/02782 | A1 | 1/1999 |
| WO | WO 00/26473 | A1 | 5/2000 |
| WO | WO 00/40805 | A1 | 7/2000 |
| WO | WO 01/14646 | A1 | 3/2001 |
| WO | WO 2007/071725 | A1 | 6/2007 |

OTHER PUBLICATIONS

Brochure—Safety Trailers, Inc.—TTMA in tow no need to stow, use at any speed, obtained on Jun. 12, 2007, 8 pgs.

Brochure—Vägverket—Pocket Facts 2006, Swedish road Administration, Roads and Facts, dated 2006, 52 pgs.

* cited by examiner

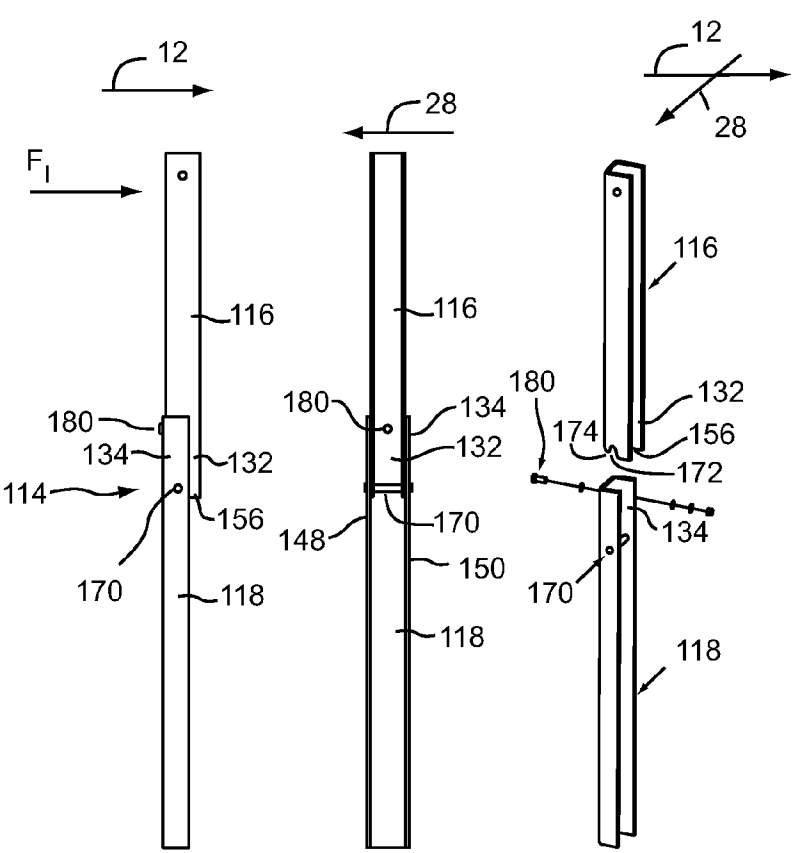
Fig.10
Fig.9
Fig.8
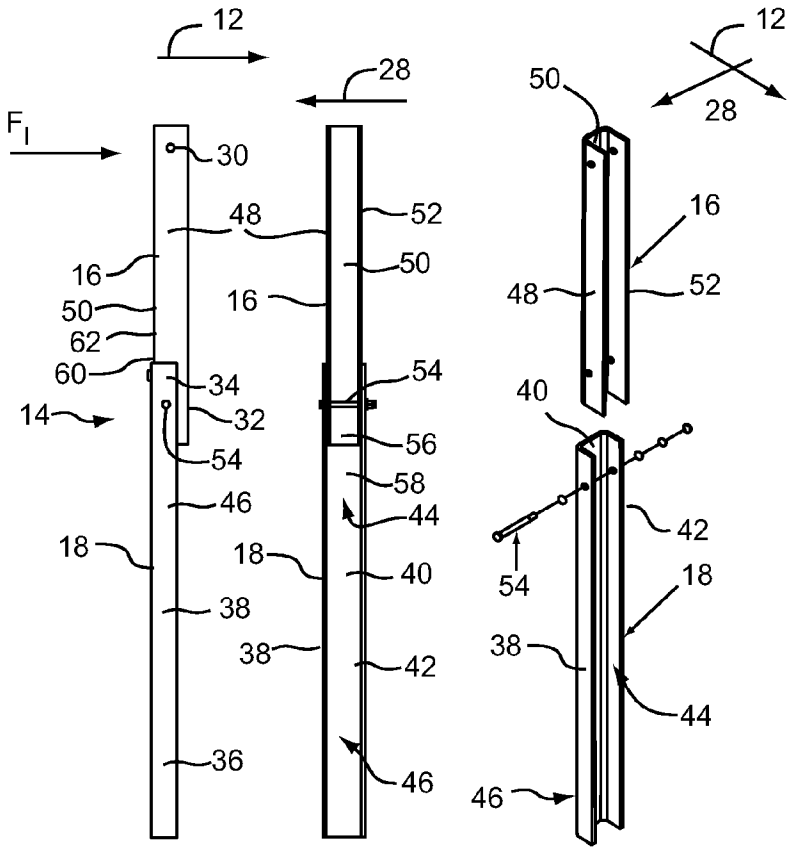
Fig.7
Fig.6
Fig.5

GUARDRAIL ASSEMBLY, BREAKAWAY SUPPORT POST FOR A GUARDRAIL AND METHODS FOR THE ASSEMBLY AND USE THEREOF

This application is a continuation of U.S. application Ser. No. 12/629,381, filed Dec. 2, 2009, now U.S. Pat. No. 8,215,619 which claims the benefit of U.S. Provisional Application 61/236,287, filed Aug. 24, 2009, and U.S. Provisional Application 61/211,522, filed Mar. 31, 2009, the entire disclosures of which are hereby incorporated herein by reference.

FIELD OF THE INVENTION

The present invention relates generally to a guardrail assembly and guardrail, for example a guardrail having an end terminal, and in particular, to a breakaway support post supporting such a guardrail, deformable rail sections, and to methods of assembling and using the support post and guardrail assembly.

BACKGROUND

Guardrail assemblies are commonly erected along the sides of roadways, such as highways, to prevent vehicles from leaving the highway and encountering various hazards located adjacent the roadway. As such, it is desirable to make the guardrails resistant to a lateral impact such that they are capable of redirecting an errant vehicle. At the same time, however, it is desirable to minimize the damage to a vehicle and injury to its occupants when impacting the guardrail assembly in an axial impact direction.

For example, it is known to provide a guardrail end treatment that is capable of absorbing and distributing an axial impact load, as disclosed in EP 0 924 347 B1 to Giavotto, entitled Safety Barrier Terminal for Motorway Guard-Rail. As disclosed in Giavotto, the guardrail system further includes a plurality of panels configured with slots. During an axial impact, the energy of the moving vehicle is attenuated by way of friction between the panels and by shearing the panel material between the slots.

At the same time, posts supporting the panels are configured to break during an axial impact such that the posts do not vault the vehicle upwardly, or cause other damage or possible injury to the impacting vehicle and its occupants. For example, Giavotto discloses securing upper and lower post members with a pair of pins extending perpendicular to the axial impact direction, with one of the pins acting as a pivot member and the other pin failing in shear during an axial impact. U.S. Pat. No. 6,886,813 to Albritton similarly discloses a hinge disposed between upper and lower support posts, with the hinge configured with a hinge pin and shear pin. Albritton also discloses other embodiments of breakaway posts, including various coupling devices employing vertically oriented fasteners that are bent during an axial impact and flanges configured with slots that induce buckling during an axial impact. Other posts, for example as disclosed in U.S. Pat. No. 4,330,106 to Chisholm or U.S. Pat. No. 6,254,063 to Sicking, disclose spaced apart upper and lower post members secured with a connector bridging between the upper and lower post members. Other known breakaway posts, such as wood posts, are configured with geometries or openings to allow the post to break away in an axial impact but provide sufficient rigidity in a lateral impact.

These various breakaway post configurations have various shortcomings For example and without limitation, any buckling or breaking of a post having slots or other openings requires that the entire post be replaced, with the attendant installation (digging, etc.) and material costs. In addition, post configurations using multiple pins or fasteners, whether failing in shear or by bending, require additional material and assembly expenses. Likewise, vertically spaced posts using separate channels and plates require extensive labor, materials and costs to refurbish after an impact, and rely on the connectors to absorb both lateral and axial loads. Moreover, when connectors or fasteners are located below grade, as disclosed for example in Giavotto, it may be necessary to excavate around the post to ensure proper engagement between the upper and lower posts.

SUMMARY

The present invention is defined by the following claims, and nothing in this section should be considered to be a limitation on those claims.

In one aspect, one embodiment of a breakaway support post for a guardrail includes overlapping upper and lower post members. The lower and upper post members are configured to be non-rotatable relative to each other about an axis extending in an axial impact direction, but the upper post member is moveable relative to the lower post member along the axial impact direction in response to an axial impact. A tensile fastener extends in the axial impact direction and connects the overlapping portions of the lower post member and the upper post member. At least one of the tensile fastener, the upper post member or the lower post member is breakable as the upper post member is moveable relative to the lower post member along the axial impact direction in response to the axial impact.

In yet another aspect, a method of attenuating energy from a moving vehicle with a guardrail assembly includes impacting an impact head with a vehicle moving in an axial impact direction, wherein the impact head is coupled to a guardrail extending longitudinally in the axial impact direction. The method further includes moving an upper post member coupled to the guardrail relative to a lower post member in the axial impact direction, wherein the lower post member is secured in the ground, and breaking at least one of a tensile fastener, the upper post member or the lower post member in response to moving the upper post member relative to the lower post member.

In yet another aspect, a method of assembling a guardrail assembly includes disposing a lower end portion of a lower post member in the ground and connecting overlapping upper and lower post members with a tensile fastener extending in an axial impact direction.

In yet another aspect, another embodiment of a breakaway support post for a guardrail includes an upper post member and a lower post member overlapping the upper post member. The lower and upper post members are configured such that the upper and lower post members are non-rotatable relative to each other about an axis extending in an axial impact direction. The upper post member is moveable relative to the lower post member along the axial impact direction in response to an axial impact. A shear fastener extends transversely to the axial impact direction and connects the lower post member and the upper post member. The shear fastener is the only connection between the upper and lower post members. At least one of the shear fastener, the upper post member or the lower post member is breakable as the upper post member is moved relative to the lower post member along the axial impact direction in response to the axial impact.

In another aspect, a guardrail assembly includes a guardrail and an impact head secured to an end of the guardrail. The guardrail is coupled to the upper post member.

In yet another aspect, a method of attenuating energy from a moving vehicle with a guardrail assembly includes impacting an impact head with a vehicle moving in an axial impact direction, wherein the impact head is coupled to a guardrail extending longitudinally in the axial impact direction. The method further includes moving an upper post member coupled to the guardrail relative to a lower post member in the axial impact direction, wherein the lower post member is secured in the ground, and breaking at least one of a shear fastener, the upper post member or the lower post member in response to moving the upper post member relative to the lower post member.

In yet another aspect, a method of assembling a guardrail assembly includes disposing a lower end portion of a lower post member in the ground and connecting overlapping upper and lower post members with a shear fastener extending transversely to an axial impact direction, wherein the shear fastener is the only connection between the upper and lower post members.

In yet another aspect, a guardrail assembly includes a first rail section having an upstream end portion, a downstream end portion and a first side. A second rail section has an upstream end portion, a downstream end portion and a second side. The upstream end portion of the second rail section overlaps with and is secured to the downstream end portion of the first rail section with the first and second sides facing each other. The first rail section is moveable relative to the second rail section from a pre-impact position to an impact position in response to an axial impact to the guardrail assembly. A deforming member is secured to the upstream end portion of the second rail section and extends laterally from the second side. The deforming member engages the first side and laterally deforms the first rail section as the first rail section is moved relative to the second rail section from the pre-impact position to the impact position.

In another aspect, a method of attenuating energy from a moving vehicle with a guardrail assembly includes impacting an impact head with a vehicle moving in an axial impact direction, wherein the impact head is coupled to a guardrail extending longitudinally in the axial impact direction. The guardrail has at least first and second rail sections, each including an upstream end portion, a downstream end portion and first and second sides respectively. The upstream end portion of the second rail section overlaps with and is secured to the downstream end portion of the first rail section with the first side of the first rail section facing the second side of the second rail section. The method further includes moving the first rail section of the guardrail relative to the second rail section, engaging the first side of the first rail section with a deforming member secured to the upstream end portion of the second rail section, and deforming the first rail section laterally with the deforming member without shearing the first rail section with the deforming member.

The various embodiments of the breakaway support post, guardrail assembly, methods of using the guardrail and methods of assembling the guardrail provide significant advantages over other breakaway support posts and guardrail assemblies. For example and without limitation, the use of a single shear (or tensile) fastener eliminates the expense of providing and installing an additional pivot pin. In addition, a single connection avoids the possibility of the pivot pin jamming the upper post member in place. Moreover, the single fastener is located above grade, providing easy access and installation. In this way, the posts can be refurbished simply by providing additional shear or tensile fasteners. At the same time, a single fastener, which is relatively small and inexpensive, can be used to safely secure the upper and lower post members without compromising the lateral stiffness and redirecting capability of the guardrail assembly.

The nested and overlapping upper and lower post members also provide for the post members to transmit forces directly between each other, rather than employing separate, costly and difficult to install/replace connectors and fasteners, used for example with vertically spaced apart post members. As such, the post members and assembly can be easily and quickly refurbished with minimal cost.

The deforming member also dissipates energy in a controlled fashion by deforming a downstream rail section. At the same time, the deformation maintains a sufficient tensile force in the fasteners securing the support plate, such that a controlled frictional force is maintained between the moving upstream rail section and the downstream rail section, between the moving upstream rail section and the support plate, and between the deforming member and the upstream rail section so as to dissipate energy during the collapse.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

BRIEF DESCRIPTION OF THE DRAWINGS

FIG. 5 is a side view of first embodiment of a breakaway support post.

FIG. 6 is a rear view of the breakaway support post shown in FIG. 6.

FIG. 7 is a perspective view of the breakaway support post shown in FIG. 5.

FIG. 8 is a side view of a second embodiment of a breakaway support post.

FIG. 9 is a rear view of the breakaway support post shown in FIG. 8.

FIG. 10 is a perspective view of the breakaway support post shown in FIG. 8.

DETAILED DESCRIPTION OF THE PRESENTLY PREFERRED EMBODIMENTS

Figures 1, 2, 3:
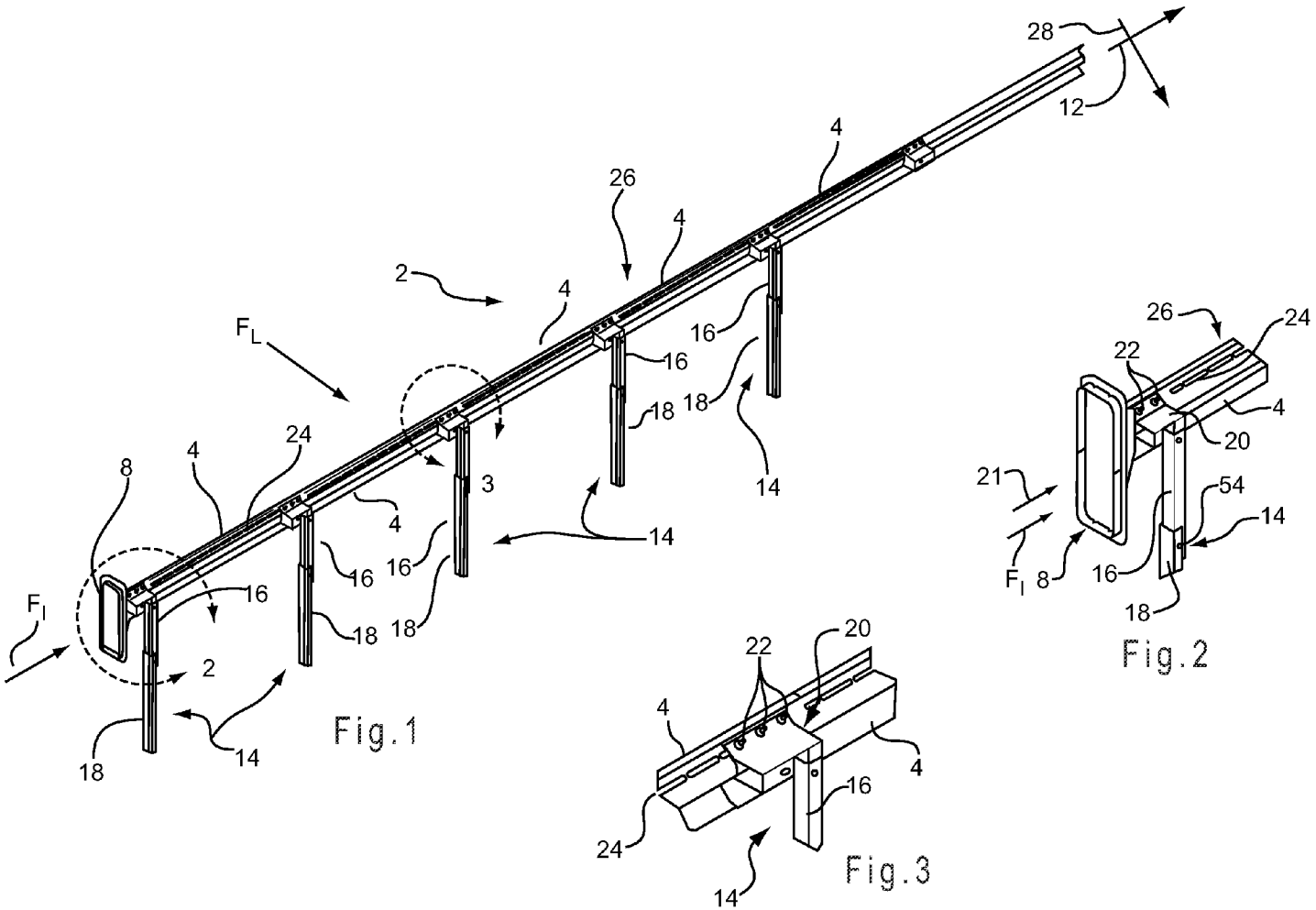
FIG. 1 is a perspective view of a guardrail having an impact head and a plurality of breakaway support posts.
FIG. 2 is an enlarged perspective view of the impact head shown in FIG. 1.
FIG. 3 is an enlarged perspective view of the connection between the breakaway support post and guardrail shown in FIG. 1.

It should be understood that the term "plurality," as used herein, means two or more. The term "longitudinal," as used herein means of or relating to length or the lengthwise direction of a guardrail, which is parallel to and defines an "axial impact direction." The term "lateral," as used herein, means directed toward or running perpendicular to the side of the guardrail. The term "coupled" means connected to or engaged with, whether directly or indirectly, for example with an intervening member, and does not require the engagement to be fixed or permanent, although it may be fixed or permanent, and includes both mechanical and electrical connection. The term "transverse" means extending across an axis, and/or substantially perpendicular to an axis. It should be understood that the use of numerical terms "first," "second" and "third" as used herein does not refer to any particular sequence or order of components; for example "first" and "second" rail sections may refer to any sequence of such sections, and is not limited to the first and second upstream rail sections unless otherwise specified. The terms "deform," "deforming," and "deformable," and variations thereof, as used herein mean to transform, shape or bend without shearing. The term "overlap" refers to two components, or portions thereof, positioned or lying over or next to each other, and is independent of the lateral position of the overlapping components, with a portion of an upstream rail section "overlapping" a portion of a downstream rail section, and vice versa.

Referring to FIGS. 1-4 and 23, a guardrail assembly 2 includes a plurality of rail sections 4, shown for example and without limitation as five, extending in the longitudinal direction. It should be understood that the guardrail assembly may be configured with more or less rail sections. In one embodiment, the last downstream rail section 4 is secured to a hazard 6, such as bridge abutment, cement barrier, downstream guardrail section or other fixed objects. The first upstream rail section 4 facing oncoming traffic is configured with an impact head 8, which shields the end of the first rail section 4 and distributes the load ($F_1$) of a vehicle 10 hitting the end of the guardrail in an axial impact direction 12. The impact head and collapsible rail sections make up an end terminal of the guardrail system. The impact head 8 may be configured with a substantially rectangular face, and is preferably made of steel. The impact head 8 has a height and is positioned such that the lower portion thereof is relatively close to the ground so as to catch non-tracking vehicles, for example the door sill of a vehicle sliding sideways into the impact head. In one embodiment, the nominal height of the top of the impact head is about 860 mm (+0/−30 mm) above the road surface, while the nominal height of the top of the rail sections is about 760 mm (+/−30 mm) above the road surface. The impact head 8 also is symmetrical, meaning it can be installed on either side of a roadway or either end of an end terminal or guardrail simply by rotating the impact head about a longitudinal or lateral axis respectively.

In one embodiment, the rail sections 4 are configured with a W-shaped cross section, although it should be understood that other cross-sectional shapes can be used. In one embodiment, the geometry of the W-shaped rail section corresponds to the standard AASHTO M-180 guardrail (Standard Specification for Corrugated Sheet Steel Beams for Highway Guardrail, AASHTO Designation: M 180-00 (2004)), American Association of State Highway and Transportation Officials, Washington D.C., 2004.

Figure 4:
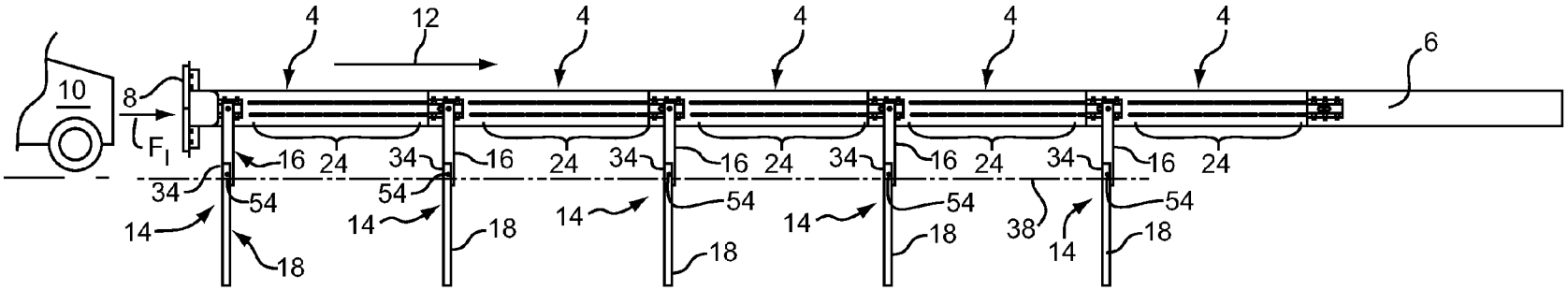
FIG. 4 is a side view of the guardrail shown in FIG. 1.
Figure 16:
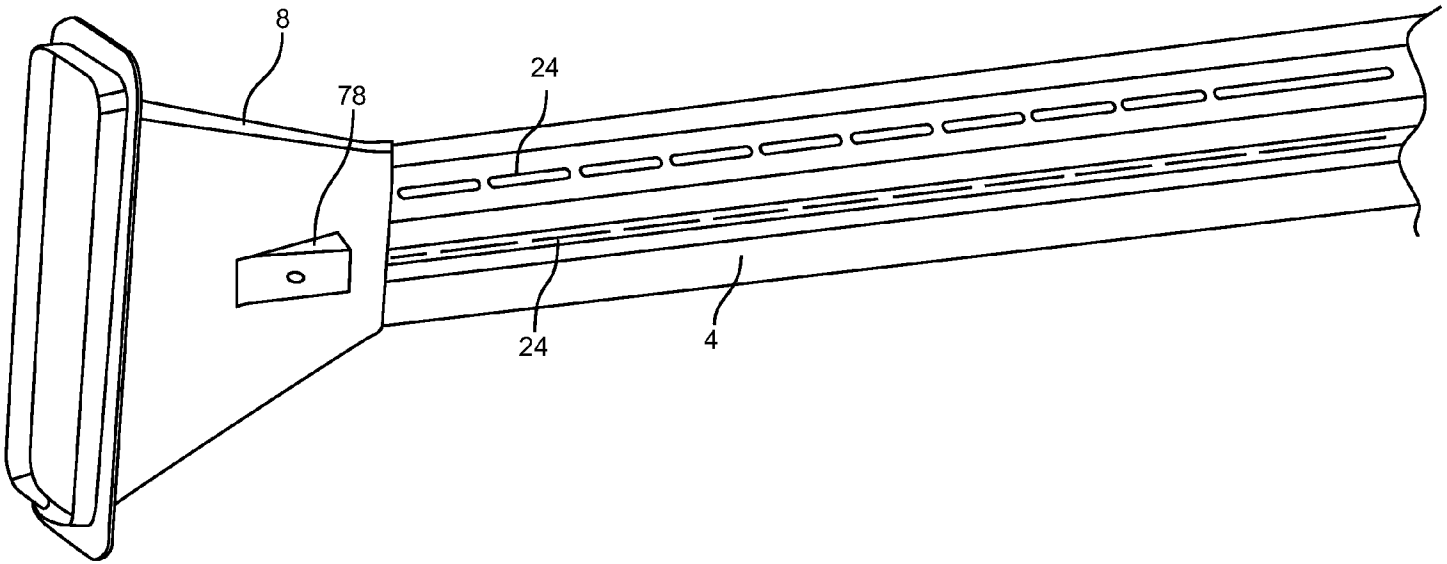
FIG. 16 is a perspective view of an impact head and first rail section.
Figure 23:
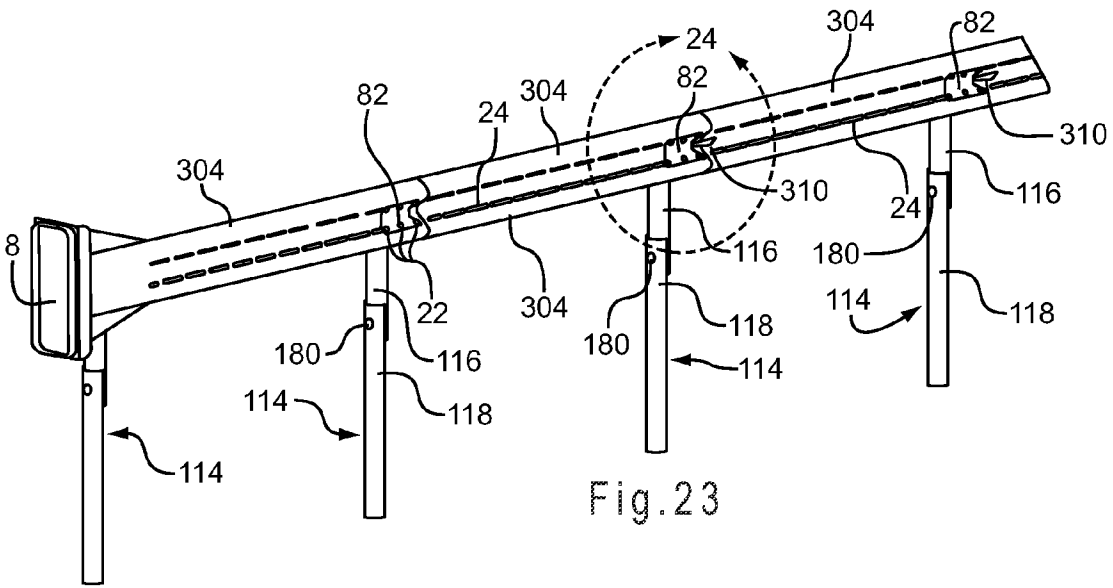
FIG. 23 is a perspective view of one embodiment of a guardrail assembly.
Figure 31:
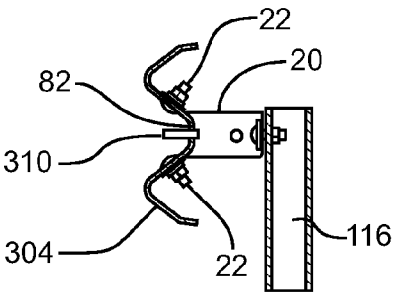
FIG. 31 is a cross-sectional view of one embodiment of a guardrail assembly shown in FIG. 30 taken along line 31-31.

In one embodiment, the guardrail assembly 2 includes a plurality of breakaway support posts 14 coupled to the rail sections 4. For example, as shown in FIGS. 1, 4 and 23, the number of breakaway posts 14 corresponds to the number of rail sections 4, with a lead breakaway post member 14 supporting an upstream end of the first upstream rail section 4, and breakaway posts coupled to overlapping portions of subsequently spaced rail sections. Preferably, the upstream rails successively overlap the downstream rails such that the upstream ends of the downstream rails are not exposed to the traffic side of the guardrail. The downstream end of the last downstream rail section 4 is coupled directly to the road hazard 6, for example with bolts or other fasteners. Alternatively, an additional support post can be provided to support the downstream end of the last rail section. Of course, it should be understood that more or less support posts may be suitably used as desired. The breakaway support posts 14 are configured to resist impact forces ($F_L$) imparted laterally to the side of the guardrail, i.e., transverse to the axial impact direction 12, but to readily break away when the guardrail is hit by a vehicle travelling in an axial impact/longitudinal direction 12. In one embodiment, each of the breakaway support posts 14 is configured with upper and lower post members 16, 18. As shown in FIGS. 2, 3 and 31, the upper post member 16, 116 is coupled to the rail section 4, 304 with a spacer 20 and a plurality of fasteners 22, shown as four for a first support post and six for successive couplings. The spacers 20 can take many suitable forms, including a hat-shaped section, a block, a tube, or other suitable shapes and configurations, and/or combinations thereof. The spacers are preferably made of steel, wood, recycled plastics or other similar materials. The upper post is secured to the spacer with fasteners, welding, and the like, and/or combinations thereof. As shown in FIG. 16, the impact head 8 may be configured with an integral spacer 78 or connector for the first support post. The spacer/connector may be secured to the impact head by welding, fasteners, or other known and suitable devices. In this way, the impact head is configured to be connected to a post member without providing and positioning a separate spacer member, which can save time during the assembly process.

Figure 17:
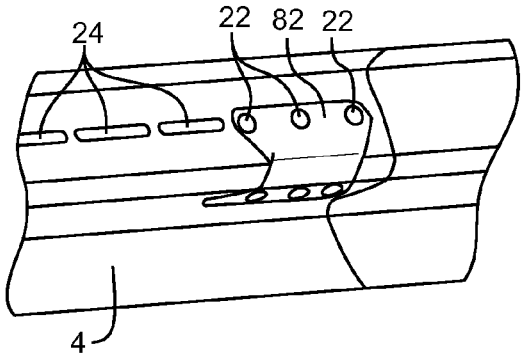
FIG. 17 is a partial side view of a traffic side of a first embodiment of a connection between two rail sections.
Figure 18:
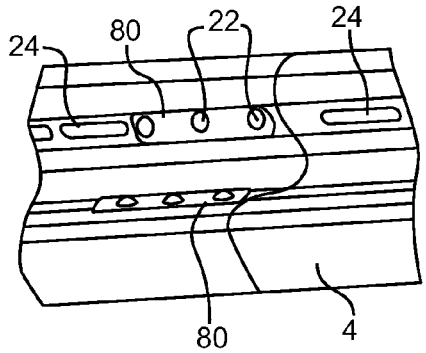
FIG. 18 is a partial side view of a traffic side of a second embodiment of a connection between two rail sections.
Figure 24:
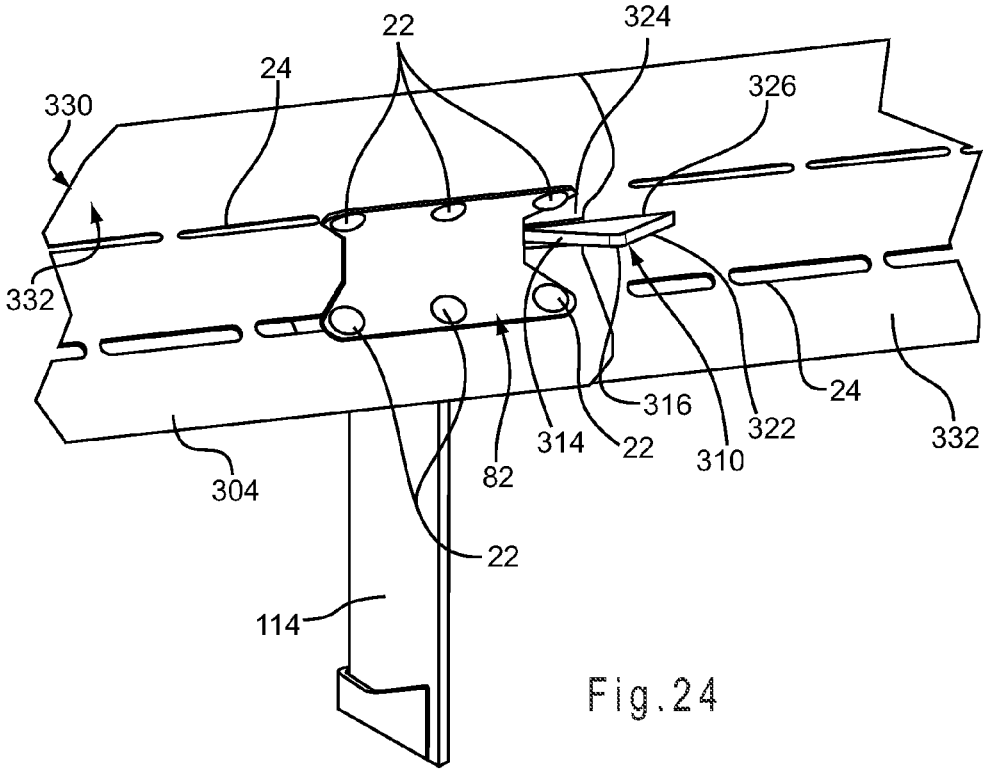
FIG. 24 is an enlarged partial, perspective view of the guardrail assembly shown in FIG. 23.
Figure 25:
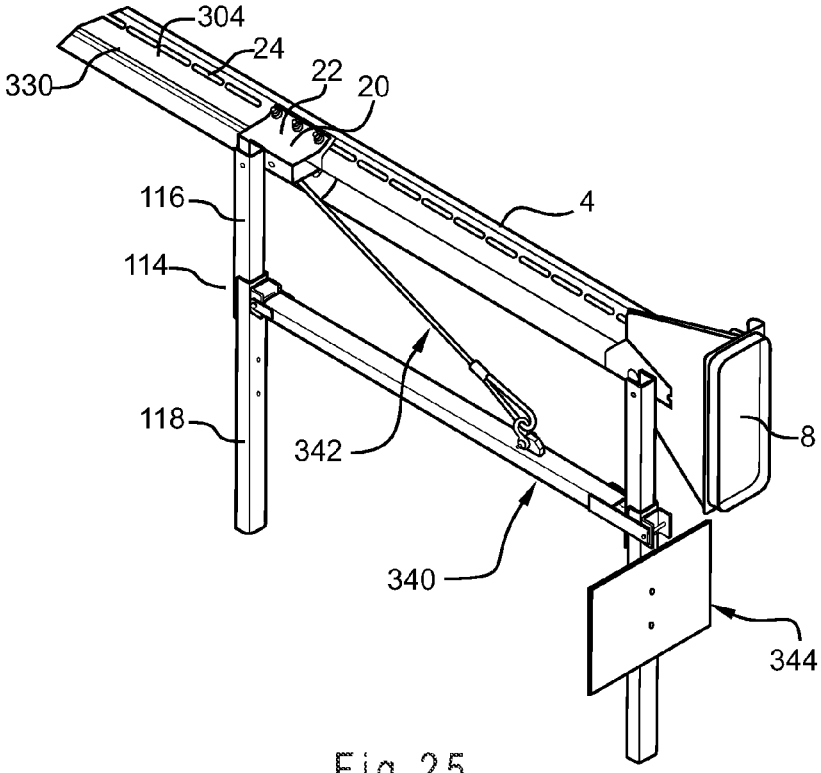
FIG. 25 is a partial perspective view of one embodiment of a first rail section and impact head configured with cable, strut and soil plate.

As shown in FIGS. 1-4, 22-24, 26 and 30, each rail section 4, 304 has a plurality of slots 24 extending and spaced apart in the longitudinal direction 12 in alignment with the fasteners 22. Upper and lower parallel rows of slots 24 can be staggered in the longitudinal direction. During an axial impact of a vehicle 10 with the impact head 8, the energy of the vehicle 10 is safely absorbed as rail sections 4, 304 successively slide past adjacent rail sections, dissipating energy through friction. The bolts 22 that hold the rail sections 4 together slide to the ends of the slots 24 in the rail section, with the bolts 22 then being forced to shear the section of rail material between successively spaced slots 24. The energy of the impacting vehicle is absorbed primarily by the friction between rail sections 4, 304 sliding relative to each other, with additional energy being also absorbed by the shearing of the material between the slots 24 and by the release of the breakaway support posts 14, 114. Referring to FIGS. 17, 18, 23 and 24, various plate configurations are disposed on the traffic side surface of the rail sections, with the bolts secured through the plates. As shown in FIG. 18, a pair of plates 80 (upper and lower) is used. As shown in FIGS. 17, 23 and 24, a single C-shaped plate 82 or bracket is provided. The plate 82 prevents the bolts 22 from pulling through the slots 24 as the material between the slots is sheared, particularly at the connection between the last rail section and the hazard.

Figure 22:
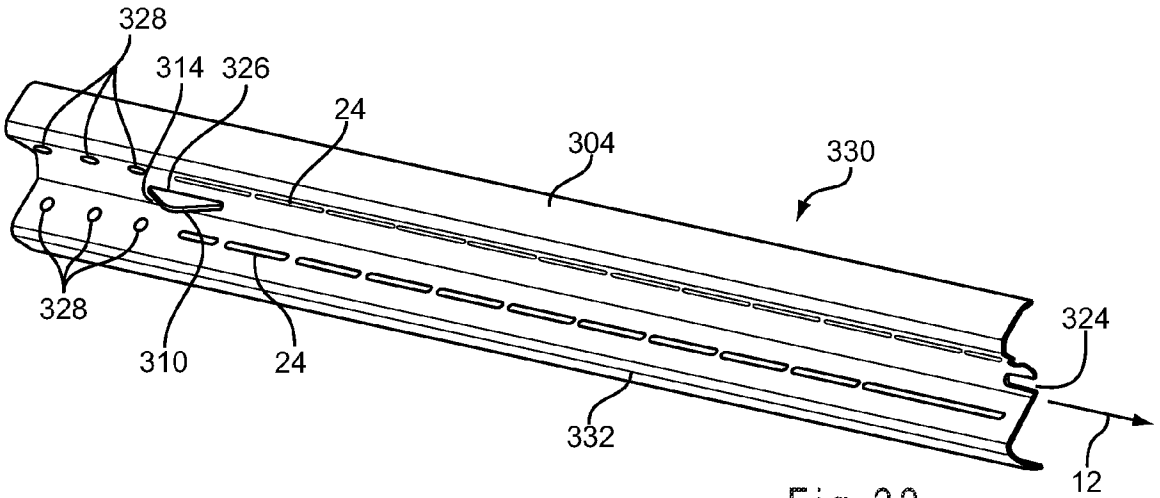
FIG. 22 is a perspective view of a rail section with a deforming member secured thereto.

Referring to FIGS. 21-24 and 30, a deforming member 310, configured in one embodiment as a shaper fin, provides for a low cost method for increasing the running load of the end terminal when impacted in the longitudinal direction. In one embodiment, the deforming member is made of metal, for example and without limitation steel. The deforming member 310 has a pair of end flanges 312, with a central portion 320 having oblique leading and trailing edges 314, 322 meeting at a curved apex 316. The corners 318 of the edges are rounded. As shown in FIGS. 22 and 24, the deforming member 310 is inserted through a slot 326 formed in an upstream end portion of each downstream rail section 304. In one embodiment, the deforming member 310 is positioned immediately downstream of fastener openings 328 used to secure the support plate 82. The apex 316 and leading/trailing edges 314, 322 extend through the slot 326, with the flanges 312 engaging a first side 330 of the rail section and the apex and leading/trailing edges extending laterally from a second side 332 of the rail section. The deforming member 310, e.g. the flanges 312 and perimeter, may be welded to the rail section 304 on one side thereof, or secured thereto with fasteners or combinations thereof, with the deforming member 310 also welded to the traffic side of the rail section. It should be understood that the deforming member could simply be secured to the second side 332 of the rail, without inserting it through a slot, for example with fasteners, welding, combinations thereof and the like. The leading edge 314 is disposed in a longitudinal slot 324 formed in a downstream end portion of the next upstream rail section, as shown in FIG. 24, when the guardrail assembly is in a pre-impact position. As explained below, the deforming member 310 engages a first side 330 of the next upstream rail section as it is moved past the deforming member 310 and thereby deforms the upstream rail section, e.g., by shaping or bending the metal but preferably without shearing the rail section as explained further below.

Referring to FIGS. 1, 2, 4, 16, 23, 25, and 30, the impact head 8 is configured as a lightweight impact head, which is fixedly attached to the first upstream rail section 4 of the guardrail, for example and without limitation by welding, fasteners, and/or other suitable devices. The impact head 8 is sized and configured to engage an impacting vehicle 10, such that the first rail section 4 is unable to pierce the impacting vehicle and thereby pose a risk to the occupants of the vehicle. The impact head 8 also is configured to be flush with the traffic facing side 26 of the guardrail, so as to minimize the risk of being inadvertently caught by passing vehicles. This feature may be important in cold weather states because snowplows typically travel very close to the traffic side face of the guardrail. In one embodiment, the impact head 8 is less than about 120 lbs (including the first rail section), which is significantly less than conventional impact heads weighing between 150 lbs to 270 lbs without the first rail section. As such, the impact head is less costly, easier to install, and applies a lower load to impacting vehicles.

Figure 26:
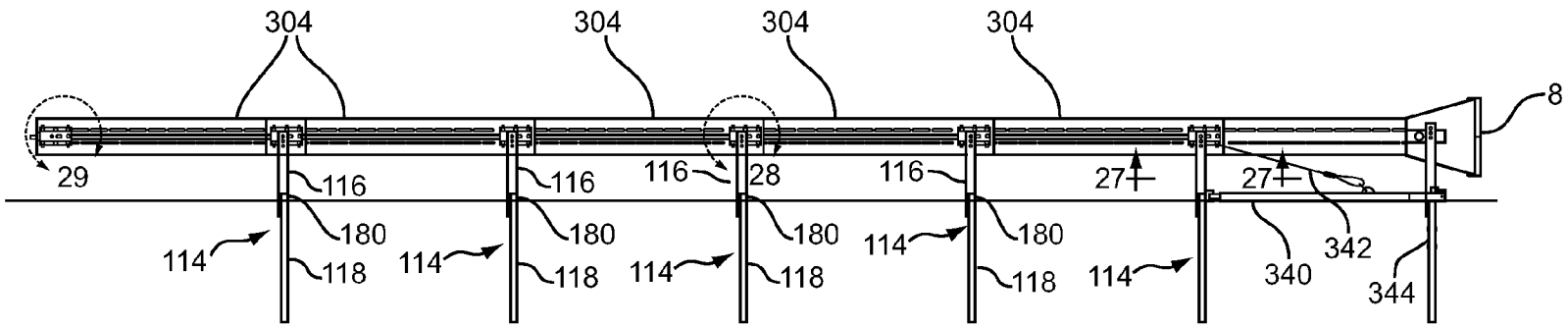
FIG. 26 is a side view of an alternative embodiment of a guardrail assembly.
Figure 28:
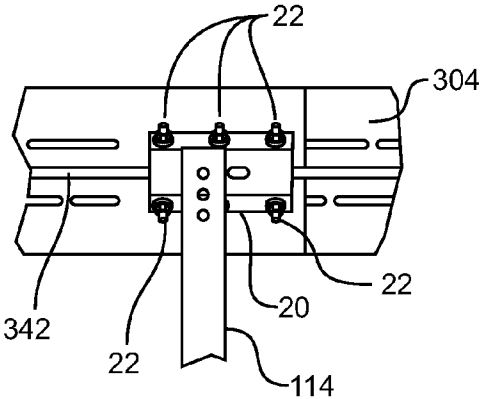
FIG. 28 is an enlarged view of a portion of the guardrail assembly shown in FIG. 26 taken along line 28.
Figure 29:
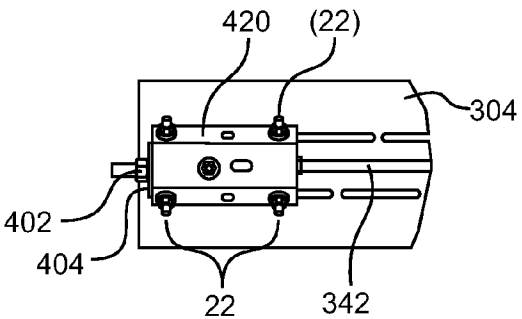
FIG. 29 is an enlarged view of a portion of the guardrail assembly shown in FIG. 26 taken along line 29.
Figure 27:
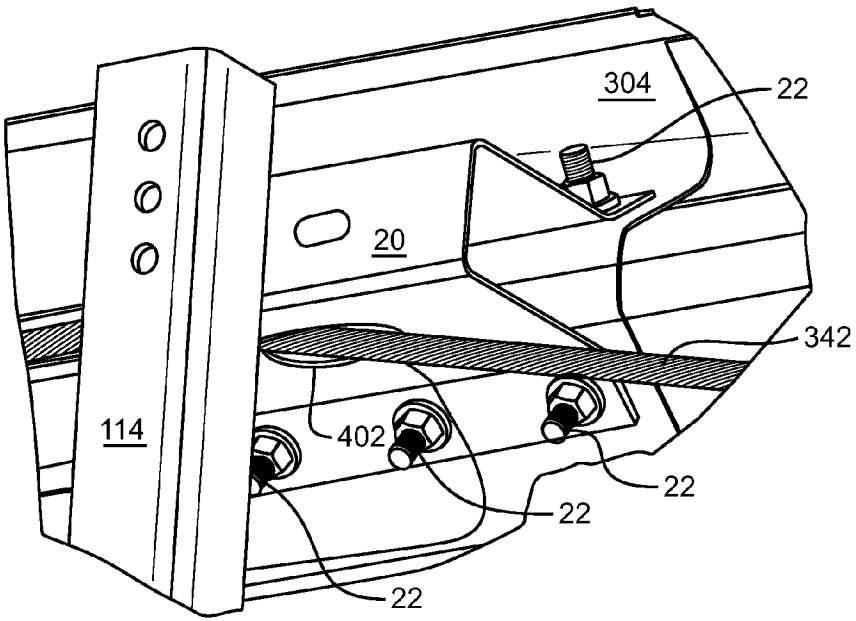
FIG. 27 is a perspective view of a portion of the guardrail assembly shown in FIG. 26 taken along line 27-27.
Figure 30:
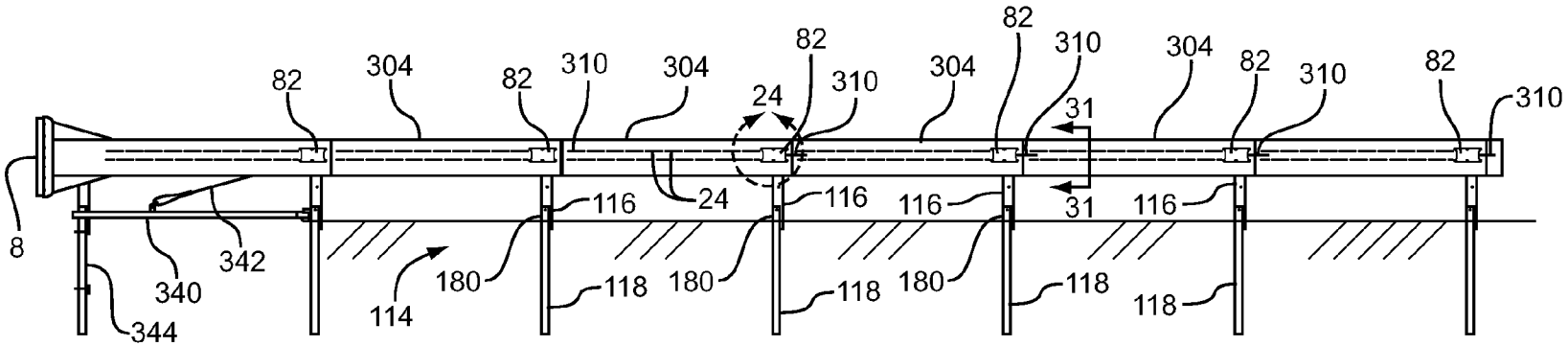
FIG. 30 is a traffic side elevation view of one embodiment of a guardrail assembly.

In the embodiment of FIGS. 25-29, a strut 340 extends between and is coupled to the first and second upstream breakaway posts 14, 114. A soil plate 344 is secured to the forwardmost lower post member so as to prevent the forwardmost lower post member from being pulled out of the ground during an impact. It should be understood that soil plates can be secured to other lower post members as deemed suitable. A cable 342 is secured to an intermediate portion of the strut 340. The cable extends through an opening 402 formed in the bottom wall of the spacer 20 coupled to the second downstream post member as shown in FIG. 27. As shown in FIGS. 26, 28 and 29, the cable 342 extends rearwardly along the length of the terminal, with the cable passing through subsequent spacers 20 such that the cable is disposed between each spacer and the attached rail section (FIG. 28). The cable 342 has an end portion secured to the last spacer 420, which functions as a cable anchor when configured with an anchor plate 404 and fastener 402 (FIG. 29). In this way, the cable 342 functions as a tether to capture and couple the spacers, rail sections and upper posts as the system is impacted. It should be understood that the cable could have a shorter length, if not desired to function as a tether, for example by securing it to the first downstream spacer or rail section positioned downstream of the first upstream rail section.

As the guardrail system collapses in the longitudinal or axial impact direction 12, the breakaway posts 14 are loaded in a weak direction, causing them to release or breakaway. Conversely, when the system is hit on the side 26 thereof, or when a lateral force vector ($F_L$) is applied thereto, the breakaway posts 14 are loaded in a lateral, strong direction 28. In this type of impact, the support posts 14 remain intact and upright, so as to support the rail sections 4 and redirect the vehicle 10 back onto the roadway.

Figure 15:
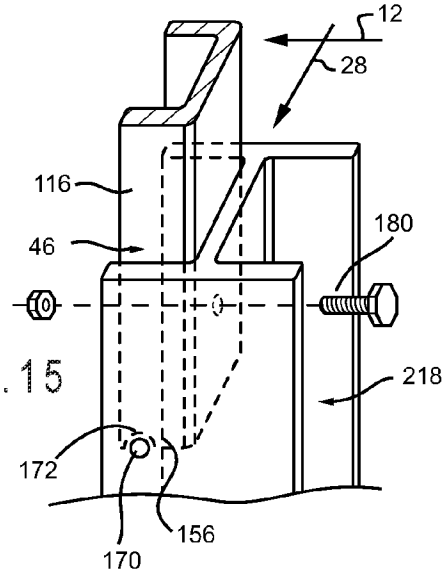
FIG. 15 is a partial perspective view of a fifth embodiment of a breakaway support post.

Referring to FIGS. 5-7, a first embodiment of the breakaway post includes upper and lower posts 16, 18, each having an upper end portion 30, 34 and a lower end portion 32, 36. As shown in FIG. 4, the lower post 18 is disposed in the ground below grade 38, with the upper end portion 34 extending slightly above grade. In one embodiment, the lower post 18 is configured with a C-shaped cross section, although it should be understood that other shapes, such as an I-shaped cross section as shown for example in FIG. 15, would also be suitable. Preferably, the lower post 18 is configured with a channel 46 defined by three sides 38, 40, 42 and an opening 44 facing downstream, or away from the vehicle travelling in the axial impact direction 12. The lower post 18 may be made of steel, such as galvanized steel, or other suitable materials. In one embodiment, the lower support post may be formed from 0.25 inch (¼) thick High Strength Low Alloy (HSLA) steel with a minimum yield strength of 50 ksi. In one embodiment, the outside overall cross section of the lower support post may be approximately 60.4 mm×95.7 mm, while the length may be 1.10 m.

The upper post 16 has a lower end portion 32 that overlaps with the upper end portion 34 of the lower post and is nested in the channel 46, meaning the upper post fits within the channel. The upper post also may be configured with a C-shaped cross section, although it should be understood that other shapes, such as an I-shaped cross section or tubular (e.g., square) cross section, would also be suitable. In one embodiment, the upper and lower posts are nested such that the upper post contacts the lower post on at least two sides 38, 42. In this way, the upper post cannot rotate relative to the lower post about an axis extending in the axial impact/longitudinal direction such that support post has a suitable strong direction rigidity. In one embodiment, the upper post is nested in the lower post with the upper post having three sides 48, 50, 52 in contact with the lower post on three sides. In another embodiment, the lower post can be nested within the upper post. The upper post may be made of steel, such as galvanized steel, or other suitable materials. The upper support post may be formed from 0.25 inch (¼) thick High Strength Low Alloy (HSLA) steel with a minimum yield strength of 50 ksi. The upper support post may have an outside overall cross section of approximately 80.0 mm×79.0 mm, while the length may be 0.735 m.

Referring to the embodiment of FIGS. 5-7, the overlapping portions 32, 34 of the upper and lower posts are coupled with a single shear fastener 54 that extends transversely (i.e., across or perpendicular) to the axial impact direction 12, or parallel to the lateral impact direction 28. The term "shear fastener" refers to a fastener, such as a pin or bolt, which is loaded by shear forces during an axial impact. The shear fastener 54, configured as a 10 mm bolt (e.g., grade 8.8 steel with a minimum tensile strength of 116 KSI) in one embodiment, is the only connection between the upper and lower posts members 16, 18, meaning the upper and lower post members are not secured or connected in any other way by fasteners, welding, adhesives, tabs, or other suitable devices, although some friction may be experienced between the nested overlapping end portions 32, 34 thereof during an axial impact. In other suitable embodiments, fasteners of other sizes, grades and materials may be used. When the upper post 16 is loaded by an impact force ($F_I$) and moved relative to the lower post 18 in the axial impact direction 12, the bottom end 56 of the upper post bears against an inner surface 58 of the lateral wall 40 of the lower post and thereby exerts a shear force on the shear fastener 54. The terms "move" and "moveable," and variations thereof, include translational movement, rotational movement and combinations thereof. As the shear force is applied, the shear fastener 54 fails in shear, thereby breaking and releasing the upper post from the lower post. In other embodiments, the shear force may pull the shear fastener through the flanges of the upper and/or lower post members. The type of failure mechanism is determined by the size and material of the shear fastener and the thickness or gauge and material of the upper and lower post members.

Conversely, if the system is loaded axially from the downstream end, the upper end 60 of the lower post exerts a force against the outer surface 62 of the lateral wall 50 of the upper post, and thereby exerts a shear force on the shear fastener 54. Due to the geometry and placement of the shear fastener, and the resultant length of the lever arms, the load applied to the shear fastener 54 in the reverse axial impact direction is less than the load applied to the fastener in the axial impact direction, thereby making the support post 14 stronger in the reverse direction. In addition, the guardrail and orientation of the breakaway posts are situated along a roadway such that a reverse axial impact load, or force vector applied in the reverse axial impact direction due to a lateral impact, is unlikely or greatly reduced.

Figures 11, 12, 13A, 13B, 14:
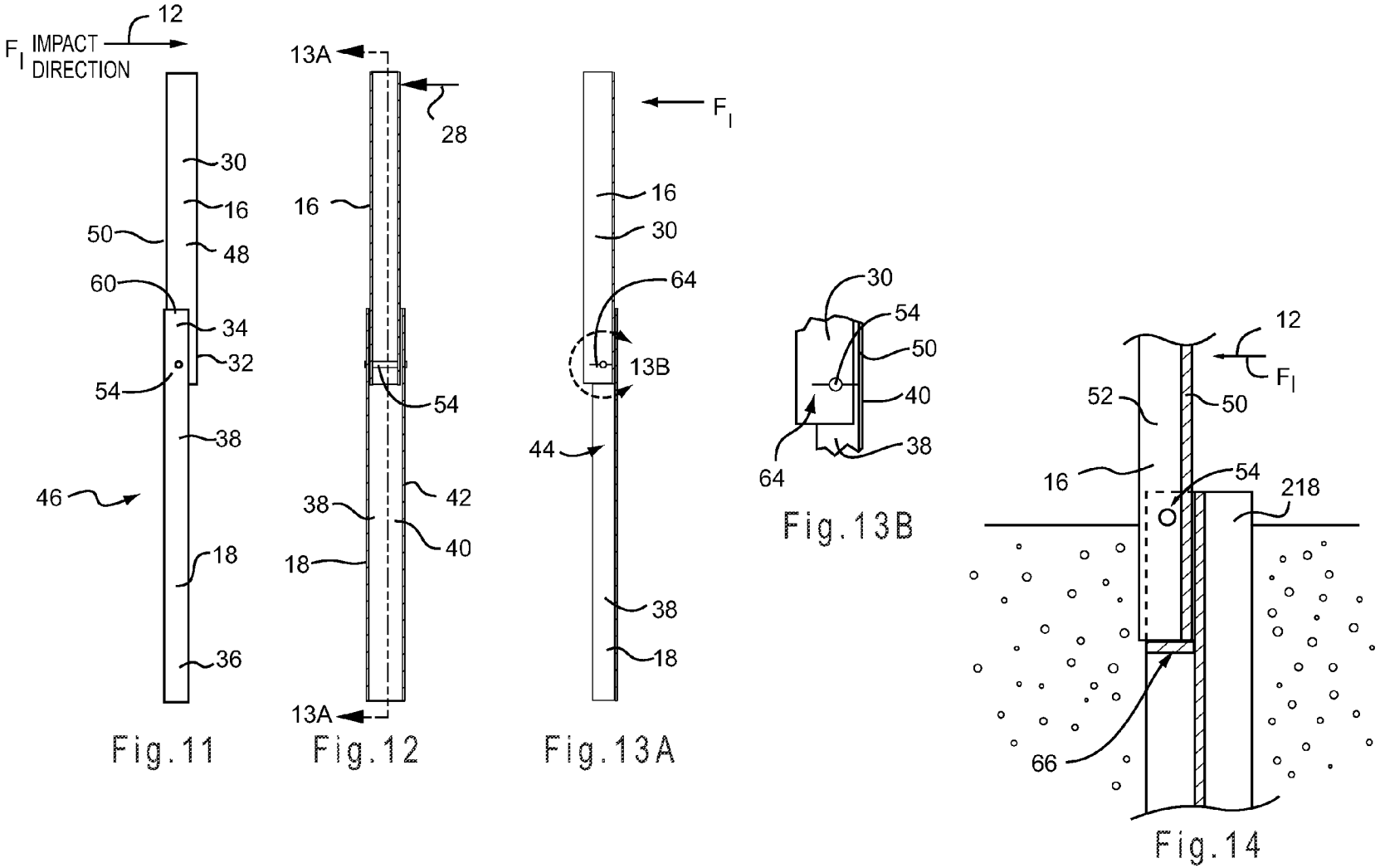
FIG. 11 is a side view of a third embodiment of a breakaway support post.
FIG. 12 is a rear view of the breakaway support post shown in FIG. 11.
FIG. 13A is a cross-sectional view of the breakaway support post shown in FIG. 12 taken along line 13A-13A.
FIG. 13B is an enlarged partial view of the breakaway support post shown in FIG. 13A.
FIG. 14 is a partial cross-sectional view of a fourth embodiment of a breakaway support post.

In an alternative embodiment, shown in FIGS. 11-13B, the upper post 14 is formed with a line of weakness 64, for example and without limitation as a slit, cut, perforation, score or other weakening along the axial impact direction 12. In one embodiment, as best shown in FIGS. 13A and 13B, a cut or slit 64 extends at least partially therethrough, and preferably extends through the laterally extending wall 50 of the upper post member. The shear fastener 54 couples the upper and lower posts and is aligned with the line of weakness 64. In operation, the shear fastener 54 shears or is pulled through the upper post along the line of weakness 64. It should be understood that the lower post could alternatively be provided with a line of weakness.

Referring to FIG. 14, the lower post 18 is configured with a support shelf 66 that extends across the channel. During assembly, the bottom end 56 of the upper post member may rest or be supported on the support shelf while the shear fastener 54 is installed.

Referring to FIGS. 8-10, an alternative embodiment of a support post 114 is shown. The support post 114 includes an upper post 116 having a lower end portion 132 overlapping an upper end portion 134 of a lower post 118. In one embodiment, the overlapping portions 132, 134 are nested, with the upper post contacting the lower post on three sides as described above with respect to the support post of FIGS. 5-7. In various embodiments, the upper and lower posts 116, 118 can be configured in the same shape and from the same materials as the posts 16, 18 described above in connection with the embodiment of FIGS. 5-7. For example, as shown in FIGS. 8-10, the lower post 118 is configured with a C-shaped cross section, while in FIG. 15, the lower post 218 is configured with an I-shaped cross section.

Figure 19:
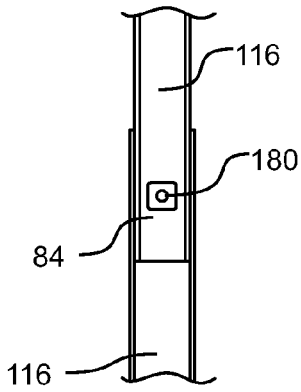
FIG. 19 is a partial rear view of a connection between an upper and lower post member.
Figure 20:
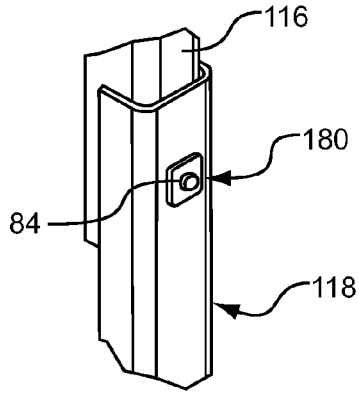
FIG. 20 is a partial front perspective view of a connection between an upper and lower post member.
Figure 21:
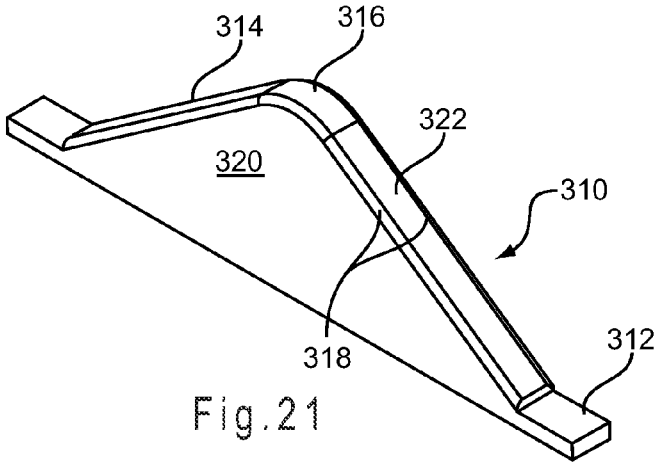
FIG. 21 is a perspective view of a deforming member.

In various embodiments, shown for example in FIGS. 8-10 and FIG. 15, the lower end 156 of the upper post 116 rests on a hinge pin 170 extending laterally between opposite side walls 148, 152 of the lower post. The lower end may be configured with a channel or slot 172 shaped to receive the hinge pin 170. The upper post 116 is further connected to the lower post 118, 218 with a tensile fastener 180 that extends longitudinally in the axial impact direction 12. The term or phrase "tensile fastener" refers to a fastener, such as a bolt or pin, which is loaded in tension during an axial impact. For example, the tensile fastener may be configured as a 10 mm bolt (e.g., grade 8.8 steel with a minimum tensile strength of 116 KSI), although other sizes, grades and materials may also be suitable, including for example and without limitation a 12 mm bolt. The fastener may be secured to the nested upper and lower posts 116, 118, 218 with washers and a nut. The tensile fastener 180 is preferably positioned above the hinge pin 170. It should be understood that in one embodiment, as shown in FIGS. 19 and 20, the hinge pin may be omitted, with the tensile fastener 180 being the only connection between the upper and lower posts 116, 118. As shown in FIGS. 19 and 20, a pair of square washers 84 is disposed on opposite sides of the upper and lower posts. The washers 84 may be welded to the upper and lower post members. The washers 84 help to ensure that in one embodiment, the tensile fastener 180 does not deform or break through the support post, but rather breaks or fails itself. In one embodiment, the lower post is installed in the ground such that a head of the tensile fastener 180 is about 15 mm (+/−15 mm) above grade. In addition, it should be understood that the shelf support 66 as disclosed in FIG. 14 can be used in conjunction with a tensile fastener, for example to support the upper post 116 on the lower post 118, 218.

When the support post 114 is impacted in a weak direction, i.e., along the axial impact direction 12, the upper post 116 rotates about the hinge pin 170, creating a tensile load in the tensile fastener 180. In one embodiment, the tensile fastener begins to stretch and then yield, until its ultimate tensile strength is exceeded, thereby releasing the upper post. In other embodiments, the tensile force applied to and by the tensile fastener pulls the tensile fastener through the lateral web of one or both of the upper and lower posts. In still another embodiment, the tensile force that is applied to the fastener pulls the fastener through a nut which fixes the fastener in place. Since the upper post 116 only rests on the hinge pin 170 and is not fixedly connected to the lower post 118 by the hinge pin, the upper post is free of any connection with the lower post once the tensile fastener or upper/lower post members fail.

As shown in FIG. 10, the lower terminal end 156 of the upper post 116 may be configured with a chamfer 174 or taper, which helps to avoid or eliminate binding between the upper and lower posts during an axial impact.

In operation during an axial impact, an impacting vehicle 10 contacts the impact head 8. The vehicle thereby applies a compressive load to the impact head 8 and subsequently to the first rail section 4. Movement of the impact head 8 and the first rail causes the first rail 4, 304 to begin sliding over the next adjacent, second rail 4, 304. During this movement, the first upper post 16, 116 begins to move relative to the first lower post 18, 118, 218. In particular, the upper post 16, 116 is capable of rotating relative to the lower post 18, 118, 218 about a transverse lateral axis extending substantially perpendicular to an axis extending in the axial impact direction 12 and substantially parallel to an axis extending in the lateral impact direction 28, as well as being translated relative to the lower post along the axial impact direction 12. As shown in the embodiment of FIGS. 8-10, the hinge pin 170 defines the lateral pivot/rotation axis. This movement continues until the connection as described herein with respect to different embodiments fails and the first upper post 16, 116 is freed from the first lower post 18, 118, 218 and is translated in the axial impact direction, preferably as it remains connected to the rail section 4, 304. At the same time the movement of the first rail section over the second rail section begins to absorb the energy of the impact as the rail material between the slots 24 is sheared and friction is created between the rail sections 4, 304.

The first rail section continues to move longitudinally and collapse until the guardrail attachment bolts 22 reach the ends of the rail slots 24. The first rail section is prevented from continuing to collapse by engagement of the fasteners with the end of the slots 24, and also by the downstream end of the impact head contacting the spacer secured to the second upper post. At this point, the second upper post 14, 114 begins to be loaded and the second rail section begins to slide over the third rail section. As a result, the connection between the second upper and lower posts fails, repeating the process described for the first post and first rail section. This process is also repeated for the third, forth, and fifth posts, as well as the third, fourth and fifth rail sections, until the system is completely collapsed or the energy of the impacting vehicle is completely absorbed and attenuated.

Referring to the embodiment of FIGS. 21-24, 26 and 30 as the system collapses (during an impact in the longitudinal direction), a first intermediate rail section 304, overlapping with a second adjacent downstream rail section 304, is forced to slide over the adjacent downstream rail section, thereby absorbing energy of the impacting vehicle through friction between the rail sections and/or support plates, predetermined and obtained by a fastener preload on fasteners 22. At the same time, the deforming member 310 engages a side 330 of the overlapping upstream rail section 304 and deforms the overlapping upstream rail section as it moves past the deforming member, thereby deforming the moving rail section in a predictable fashion and absorbing additional energy. In addition, as the overlapping rail section is deformed laterally outwardly, a lateral force is produced against the support plate 82, which is secured to the downstream rail upstream of the deforming member with fasteners 22. In this way, the moving upstream deformed rail section biases the support plate 82 laterally outwardly, thereby imparting a tensile force to the fasteners 22. This interaction helps to maintain the preload of the fasteners 22 securing the overlapping rail sections 304 to the support plate 82 and spacer 20. In one embodiment, the fasteners are provided with an initial 120 ft-lbs of torque. In this way, a predetermined frictional force is maintained between the overlapping rail sections 304 as the upstream rail section moves relative to the downstream rail section, between the moving upstream rail section and the support plate 82, and between the deforming member 310 and the moving rail section. This process of deformation is repeated for subsequent rail section movements. Rail sections configured with deforming members have running loads between about 50 kN to 90 kN in one embodiment, although lower or high values could also be achieved or realized, depending upon the application.

Although FIG. 23 shows, in one embodiment, that the deforming member is omitted at the junction between the first and second upstream rail sections, it should be understood that a deforming member could be located at that junction. Moreover, deforming members can be used at all of the other junctions, or at a limited number thereof. For example, in the embodiment of FIG. 26, the deforming member is omitted at the junction with the last rail section, while in the embodiment shown in FIG. 30, a deforming member 310 is positioned at the tail end of the last rail section 304, such that the deforming member 310 deforms the last rail section 304. The shape and configuration of the deforming members can be altered so as to provide greater or lesser energy dissipation during the collapse sequence, for example by providing a deforming member having a greater lateral height at a downstream junction or a different slope or trajectory of the leading edge slope.

The amount of energy absorbed by the rail section 304 is determined and controlled by the geometry of the deforming member 310 (height, width, and slope of leading edge), as well as by the distance of the leading edge 314 from the support plate 22 that connects the two adjacent rail sections. In one exemplary the deforming member has an overall length of about 200 mm, a height of 58.9 mm and a width of 13 mm. Of course, it should be understood that other shapes and configurations would also work. The rounded edges 318 and curved apex 316 ensure that the deforming member deforms rather than shears the rail section 304.

In operation during a lateral impact, lateral forces ($F_L$) applied to the rail sections 4, 304 in turn apply a lateral force and moment to the upper post 16, 116. The overlapping end portions of the upper and lower posts absorb the lateral forces and moments, thereby remaining rigid and redirecting the vehicle onto the roadway.

The guardrail can be quickly and easily assembled by disposing the lower post members 18, 118, 218 in the ground. If desired, additional ground anchors or reinforcements (not shown) can be used with the lower post members so as to resist any rotation or pull-out of the lower post members. The support may be preassembled, with the upper post member 16, 116 connected to the lower post member 18, 118, 218. In other embodiments, the upper and lower posts are connected on site, for example after the lower post is driven into the ground. The rail sections 4 are secured to the support posts 14, 114, with the connector bolts 22 secured with a predetermined torque (e.g., 120 ft-lbs) so as to apply a desired clamping force between adjacent and overlapping rail sections 4, which in turn produces a desired friction force therebetween during an axial impact. It should be understood that more or less torque can be applied to the connector bolts 22 to vary the clamping force and thereby produce different friction forces between the rail sections 4 during an axial impact.

After an axial impact, the various embodiments of the guardrail can be quickly and easily refurbished. Referring to the embodiment of FIGS. 5-7, wherein the shear fastener 54 fails in shear, it may be possible to reuse the same upper and lower posts 16, 18, with only the shear fastener 54 being replaced. In particular, the upper post 16 is nested in the lower post 18, or in the embodiment of FIG. 14 rested on the shelf support 66, with a new shear fastener 54 then being installed between and through the upper and lower posts. Since the shear fastener 54, which is located above grade 38, is the only connection between the upper and lower post members, the support posts can be easily and quickly refurbished without having to dig or clean out the lower post, and without having to examine or inspect a lower fastener or hinge pin below grade 38.

In other embodiments, for example the embodiment of FIGS. 11-13B, where the post member 16 is sheared along the line of weakness 64, the upper post is replaced. In some situations after inspection, the shear fasteners 54 may be reused.

In the embodiment of FIGS. 8-10, where the tensile fastener 180 fails, the upper post 116 is simply nested relative to the lower post 118, 218 and a new tensile fastener 180 is installed. In an embodiment where a hinge pin 170 is provided, the upper post 116 is rested on the hinge pin 170 with the tensile fastener 180 thereafter installed. In other embodiments, where a hinge pin is omitted, the upper post can be supported by a shelf support 66, or simply held in place while a new tensile fastener 180 is installed.

The use of a single shear (or tensile) fastener 54, 180 eliminates the expense of providing and installing an additional hinge/pivot pin. In addition, a single connection avoids the possibility of the hinge/pivot pin jamming the upper post member in place. At the same time, a single fastener, which is relatively small and inexpensive, can be used to safely secure the upper and lower post members without compromising the laterally stiffness and redirecting capability of the guardrail assembly.

Instead, the nested and overlapping upper and lower post members 16, 116, 18, 118, 218 provide for the post members to transmit forces directly between each other, rather than employing separate, costly and difficult to install/replace connectors and fasteners, used for example with vertically spaced apart post members. As such, the post members and assembly can be easily and quickly refurbished with minimal cost.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A guardrail assembly comprising:

a first rail section comprising an upstream end portion, a downstream end portion and a first side;

a second rail section comprising an upstream end portion, a downstream end portion and a second side, wherein said upstream end portion of said second rail section overlaps with and is secured to said downstream end portion of said first rail section with said first and second sides facing each other, and wherein said first rail section is moveable relative to said second rail section from a pre-impact position to an impact position in response to an axial impact to the guardrail assembly; and a deforming member secured to said upstream end portion of said second rail section and extending laterally from said second side, wherein said deforming member slideably engages said first side and laterally deforms said first rail section outwardly away from said second rail section as said deforming member slides along said first side as said first rail section is moved relative to said second rail section from said pre-impact position to said impact position.

2. The guardrail assembly of claim 1 wherein said deforming member comprises an oblique leading edge and a rounded apex facing toward and slideably engaging said first side of said first rail section.

3. The guardrail assembly of claim 1 wherein said first rail section comprises a slot receiving at least a portion of said deforming member when said first rail section is in said pre-impact position.

4. The guardrail assembly of claim 1 further comprising an impact head coupled to a third rail section, wherein said first and second rail sections are positioned downstream of said third rail section.

5. The guardrail assembly of claim 1 further comprising a breakaway support post connected to said second rail section, said breakaway support post comprising:

an upper post member; and a lower post member, wherein said lower and upper post members are non-rotatable relative to each other about an axis extending in an axial impact direction, and wherein said upper post member is moveable relative to said lower post member along said axial impact direction in response to an axial impact.

6. The guardrail assembly of claim 5 wherein said lower and upper post members are overlapping, and further comprising a tensile fastener extending in the axial impact direction and connecting the overlapping portions of said lower post member and said upper post member, wherein at least one of the tensile fastener, said upper post member or said lower post member is breakable as said upper post member is moved relative to said lower post member along the axial impact direction in response to the axial impact.

7. The guardrail assembly of claim 6 wherein said tensile fastener is breakable in tension in response to the axial impact.

8. The guardrail assembly of claim 6 wherein one of said upper and lower post members is breakable in response to the axial impact as said tensile fastener is pulled through one of said upper or lower post members.

9. The guardrail assembly of claim 6 wherein said upper post member is engaged with said lower post member at a location vertically spaced from said tensile fastener as said upper post member is moved relative to said lower post member along the axial impact direction in response to the axial impact so as to put said tensile fastener in tension.

10. The guardrail assembly of claim 5 wherein said upper post member has a lower end portion and said lower post member has an upper end portion, wherein said upper end portion of said lower post member and said lower end portion of said upper post are nested on at least three sides.

11. The guardrail assembly of claim 5 wherein the axis is a first axis and wherein the upper post member is rotatable relative to said lower post member about a second axis substantially perpendicular to the first axis in response to the axial impact.

12. The guardrail assembly of claim 5 wherein at least one of said upper and lower post members is configured with a C-shaped cross section.

13. The guardrail assembly of claim 1 wherein said deforming member slideably engages said first side and laterally deforms said first rail section without shearing said first rail section.

14. A guardrail assembly comprising:

a first rail section comprising a first side;

a second rail section comprising a second side, wherein a first portion of said first rail section overlaps a second portion of said second rail section with said first and second sides facing each other, and wherein said first rail section is moveable relative to said second rail section from a pre-impact position to an impact position in response to an axial impact to the guardrail assembly;

a deforming member slideably engageable with and biasing said first rail section laterally away from said second rail section as said first rail section slides over said deforming member and is moved relative to said second rail section from said pre-impact position to said impact position; and at least one fastener biasing said first rail section against said deforming member as said first side is moved relative to said second rail section from said pre-impact position to said impact position, wherein a tensile force is applied to said at least one fastener as said first rail section is moved relative to said second rail section from said pre-impact position to said impact position.

15. The guardrail assembly of claim 14 wherein said deforming member is disposed between and spaces apart at least portions of said first and second rail sections as said first rail section is moved relative to said second rail section from said pre-impact position to said impact position.

16. The guardrail assembly of claim 15 wherein said deforming member is engageable with said first and second sides of said first and second rail sections respectively as said first rail section is moved relative to said second rail section from said pre-impact position to said impact position.

17. The guardrail assembly of claim 14 wherein said deforming member is fixedly secured to said second rail section.

18. The guardrail assembly of claim 14 wherein said deforming member comprises a rounded surface facing toward and engaging said first side of said first rail section.

19. The guardrail assembly of claim 18 wherein said deforming member comprises a flat surface engaging said second side of said second rail section.

20. The guardrail assembly of claim 14 wherein said deforming member biases said first rail section laterally away from said second rail section without shearing said first rail section.

* * * * *

UNITED STATES PATENT AND TRADEMARK OFFICE

CERTIFICATE OF CORRECTION

PATENT NO. : 8,360,400 B2
APPLICATION NO. : 13/459946
DATED : January 29, 2013
INVENTOR(S) : Patrick A. Leonhardt et al.

It is certified that error appears in the above-identified patent and that said Letters Patent is hereby corrected as shown below:

In the Claims

In column 15, claim 14, line 31, after "section as said first" replace "rail section" with --side--.

In column 16, claim 14, line 2, after "member as said first" replace "side" with --rail section--.

Signed and Sealed this
Fourteenth Day of May, 2013

Teresa Stanek Rea
*Acting Director of the United States Patent and Trademark Office*